United States Patent [19]

Boroughs

[11] Patent Number: 4,474,645

[45] Date of Patent: Oct. 2, 1984

[54] SECONDARY HEADBOX FOR CYLINDER MACHINE

[75] Inventor: Deborah M. Boroughs, Lancaster, Pa.

[73] Assignee: Armstrong World Industries, Inc., Lancaster, Pa.

[21] Appl. No.: 452,129

[22] Filed: Dec. 22, 1982

[51] Int. Cl.[3] ..... D21F 1/00; D21F 1/04

[52] U.S. Cl. ..... 162/300; 162/125; 162/216; 162/299; 162/326; 162/327

[58] Field of Search ..... 162/298, 299, 300, 326, 162/327, 342, 123, 125, 128, 212, 216

[56] References Cited

U.S. PATENT DOCUMENTS

| | | | |
|---|---|---|---|
| 1,360,684 | 11/1920 | Roberts | 162/298 |
| 1,996,343 | 4/1935 | Miss | 162/299 X |
| 1,997,136 | 4/1935 | Devereux | 162/327 X |
| 2,390,977 | 12/1945 | Williams | 162/342 |
| 3,979,254 | 7/1976 | McIntyre | 162/299 |
| 4,153,503 | 5/1979 | Booth et al. | 162/123 |

*Primary Examiner*—S. Leon Bashore
*Assistant Examiner*—K. M. Hastings

[57] ABSTRACT

A conventional Oliver board forming machine is provided with a second trough which places a second slurry of fibrous material on the Oliver roll to form a board structure of two separate distinct layers.

The second trough has an inclined chute forming the side of the trough adjacent the Oliver roll. The chute is pivoted at one end to the second trough and its opposite end rests against the top surface of the fiber deposition on the circumference of the Oliver roll.

2 Claims, 1 Drawing Figure

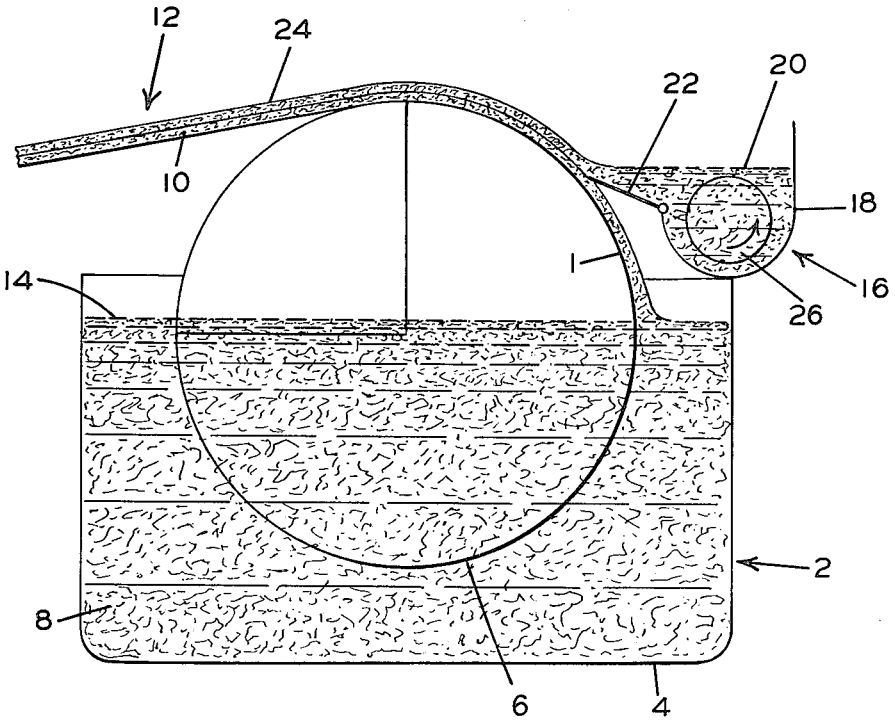
12
24
22
20
10
18
1
14
16
26
2
8
6
4

SECONDARY HEADBOX FOR CYLINDER MACHINE

BACKGROUND OF THE INVENTION

1. Field of the Invention

The invention is directed to an apparatus for forming a water-laid board structure and, more particularly, for forming a water-laid board structure on an Oliver machine. The board structure being formed is composed of two distinct layers.

2. Description of the Prior Art

U.S. Pat. No. 1,996,343 shows an Oliver board forming machine with a second slurry layer being deposited on the board formed on the cylinder of the Oliver. U.S. Pat. No. 4,153,503 teaches the making of a water-laid board product using a seconday headbox.

U.S. Pat. No. 3,979,254 discloses an apparatus for utilizing a secondary headbox structure in a fourdrinier machine. U.S. Pat. Nos. 1,347,724; 1,360,684; 1,526,553; 1,739,038; 1,756,754; 1,794,433; 1,847,269; 3,111,454; and 3,782,555, along with Italian Pat. No. 296,449 and Norwegian Pat. No. 19,200 all show different embodiments of Oliver board forming machines.

SUMMARY OF THE INVENTION

The invention is directed to an improvement in a conventional Oliver board forming machine. The basic Oliver board forming machine has a trough containing a first slurry of fibrous material which is to be formed into a board. The roll means or cylinder is positioned within the trough with approximately 50–70% of the circumference the roll means below the level of the slurry. The roll means has a vacuum maintained within the roll such that the roll means will have its circumference covered with a deposition of fibers as it moves through the slurry.

The improvement herein is the utilization of a second trough positioned adjacent the roll means at the point just after the surface of the roll means leaves the slurry. The second trough contains a second slurry of fibrous material which is different in composition from the composition of the first slurry. The second trough has an upwardly inclined chute forming the side of the second trough adjacent the roll means of the Oliver machine. The chute is pivoted at one end to the second trough and at its opposite end rests against the top surface of the fiber deposition on the circumference of the roll means. The chute and trough are adjustable to provide a puddle of slurry material from the second trough against the fiber deposition on the circumference of the roll means of the Oliver machine whereby the fibers from the second slurry are deposited over top of the fibers of the first slurry on the surface of the board which was formed on the roll means of the Oliver machine.

BRIEF DESCRIPTION OF THE DRAWING

The drawing is an end view of the invention herein.

DESCRIPTION OF THE PREFERRED EMBODIMENT

The invention herein is an improvement in an Oliver board forming machine. The basic Oliver machine 2 consists of a trough 4 which contains a first slurry of fibrous material 8 which is to be used ultimately to form the base 10 of the board 12. A roll means 6 is positioned within the trough with approximately 50 to 70 percent of the circumference of the roll means below the level 14 of the first slurry in the trough 4. The roll means has a vacuum maintained within the roll means such that the roll means will have deposited on its circumference a deposition of the fibers from the first slurry 8 as the roll means rotates through the slurry.

The vacuum exists on the surface of the roll means in the region encompassed by approximately the nine o'clock position of the roll means where the roll means is even with the level 14 of the slurry in a counter clockwise direction all the way around to the twelve o'clock position. It is only in the twelve o'clock position back down to the nine o'clock position that no vacuum is maintained in the surface of the roll 6.

The improvement of the invention herein is the provision of a particular secondary headbox 16 which is composed of a second trough 18 positioned adjacent the roll means at a point just after the surface of the roll means leaves the slurry. The trough is positioned at approximately the one to two o'clock position of the roll 6. The second trough 18 contains a second slurry 20 of fibrous material which is different in composition from the composition of the first slurry 8. The second trough means has an upwardly inclined chute 22, as shown in the drawing, which forms one side of the second trough, and this chute is adjacent the roll means 6. The chute 22 at one end is pivoted to the second trough and at its opposite end rests against the top surface of the fiber which was deposited on the circumference of the roll 6. This fiber which was deposited on the surface of the roll 6 forms the base 10 of the board product 12. The chute and trough are adjustable to provide a puddle of slurry material from the second trough against the fiber deposition on the circumference of the roll whereby the fibers from the second slurry are deposited by means of vacuum action over top of the fibers of the first slurry, on the circumference of the board being formed on the roll means, to form the second layer 24 of the board 12. As shown in the drawing, the chute 22 and trough 18 are so positioned that a puddle of slurry is formed adjacent the Oliver roll and there is formed at that point approximately an 8" long puddle of slurry along the circumference of the Oliver roll. This provides the desired deposition of second layer of material on the board. By varying the amount of coverage of the puddle of the second slurry on the Oliver roll you can vary the thickness of the second layer on the board product 12.

The trough is pivotedly mounted so that it may be rotated to vary the amount of slurry material which will roll over the side of the chute 22 onto the Oliver roll 6. Naturally as the inclination of the trough 18 is varied so that position of chute 22 must vary so that the upper edge of the chute 22 is always resting on the first layer deposited on the Oliver roll 6. Agitator 26, which is conventional in the art, is provided in the trough 18 to keep stirred up the fibrous slurry in the trough. Agitator 26 is a rotating perforated roll.

The composition of the first slurry in the trough 4 has basically the following formulation by percent:

Mineral Wool: 23.0%
5 lb. Perliet: 22.0%
Newsprint: 30.0%
Broke (scrap board product): 15.0%
Starch: 10.0%

The composition of the second slurry will have the following formulation by percent:

Mineral Wool: 25%
Clay: 38%
5 lb. Perlite: 15%
Newsprint: 11%
Starch: 10.6%
Alum: 0.4%

The invention is not restricted to just the above formulations but could be used with other formulations such as that disclosed in U.S. Pat. No. 4,153,503. In effect, the two formulations are varied so that the secondary slurry provides a denser or impact resistant layer over the base product which could be less impact resistant.

What is claimed is:

1. An improvement in an Oliver board forming machine comprising:

(a) a trough means containing a first slurry of fibrous material which is to be formed into a board, (b) a roll means positioned within said trough with approximately 50%–70% of the circumference of the roll means below the level of the first slurry, (c) said roll means having a vacuum means maintained within the roll means such that the roll means has its circumference covered with a deposition of fiber as it moves through the first slurry, and (d) the improvement comprising:

(1) a second trough positioned adjacent the roll means at the point after the surface of the roll means leaves the first slurry, (2) said second trough containing a second slurry of fibrous material different in composition from the composition of the first slurry, (3) said second trough having an upwardly inclined chute forming the side of the second trough adjacent the roll means, (4) said chute at one end being pivoted to the second trough and its opposite end resting upon the top surface of the fiber deposition on the circumference on the roll means, and (5) said chute, when adjusted, always has the edge thereof resting against the fiber deposition on the circumference of the roll means, said chute and said seonc trough, when adjusted, can provide a smaller or larger puddle of second slurry on the roll means while maintaining the upper edge of the chute always resting against the roll means whereby the size of the puddle of second slurry can vary the thickness of the second slurry deposited.

2. The Oliver board forming machine as set forth in claim 1 wherein:

(a) the slurry of the second trough has therein a rotating perforated roll to keep stirred up the fibrous slurry and, therefore, maintain uniform suspension of the fibers.

* * * * *